United States Patent [19]

Montgomery et al.

[11] Patent Number: 4,488,312

[45] Date of Patent: Dec. 11, 1984

[54] ELECTRIC ARC FURNACE ELECTRODES

[75] Inventors: Robert W. Montgomery, Sheffield; Henry C. Garner, Mexborough, both of England

[73] Assignee: British Steel Corporation, England

[21] Appl. No.: 497,591

[22] Filed: May 24, 1983

[30] Foreign Application Priority Data

Jun. 4, 1982 [GB] United Kingdom ..... 8216323

[51] Int. Cl.[3] ..... H05B 7/08

[52] U.S. Cl. ..... 373/93

[58] Field of Search ..... 373/93, 88, 92, 91

[56] References Cited

U.S. PATENT DOCUMENTS 4,121,042 10/1978 Prenn .
4,287,381 9/1981 Montgomery ..... 373/93
4,291,190 9/1981 Elsner et al. ..... 373/93

FOREIGN PATENT DOCUMENTS 867876 10/1978 Belgium .
1223162 2/1971 United Kingdom .
2037549 7/1980 United Kingdom .

*Primary Examiner*—Roy N. Envall, Jr.
*Attorney, Agent, or Firm*—Bacon & Thomas

[57] ABSTRACT

This invention relates to a water-cooled arc furnace electrode comprising a double-walled tubular metal column the two walls being electrically insulated from one another and defining an annular channel between them. The inner wall is electrically connected to a conductive screw-threaded member from which graphite sections depend, and this inner tube defines a central channel constituting a water flow path connected in series with the annular channel via a "spider" in the aforesaid member. In accordance with this design the volume of water contained within the electrode column approaches the maximum, ensuring adequate cooling during electrode changes which hitherto has presented problems in other designs of this component.

12 Claims, 1 Drawing Figure

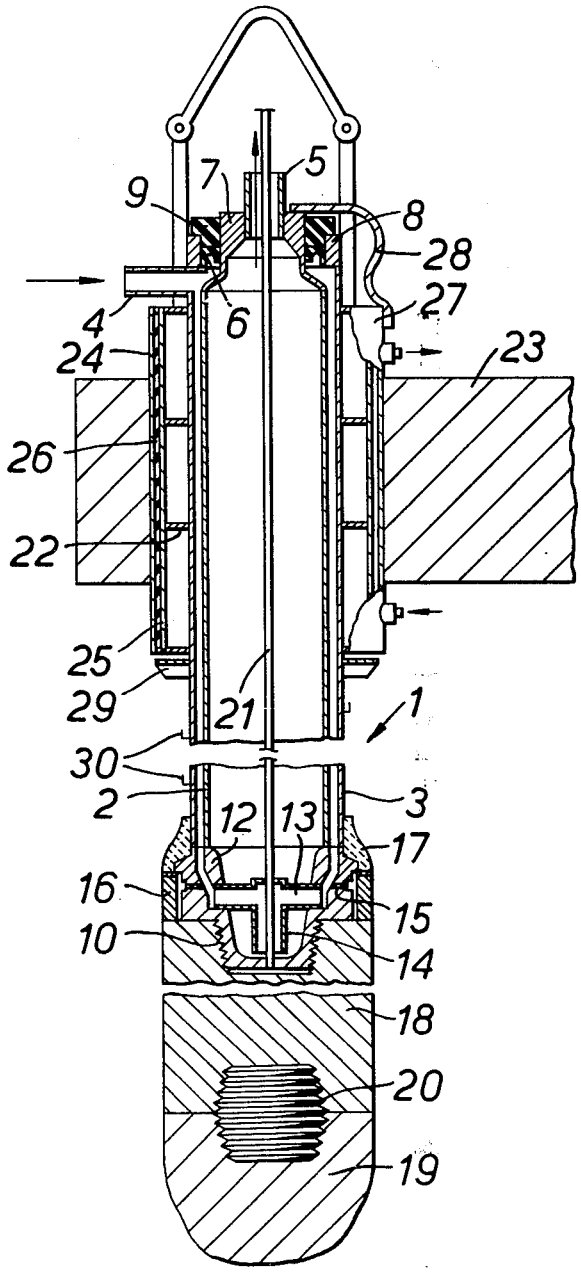
9
7
5
8
28
27
4
6
24
23
26
22
25
29
21
1
30
2
3
12
13
17
16
15
10
14
18
20
19

ELECTRIC ARC FURNACE ELECTRODES

This invention relates to electrodes for electric arc furnaces, more particularly steelmaking furnaces.

In electric arc steelmaking practice the graphite or carbon electrodes employed are consumed not only at the tip where the arc is struck but also along the column as a result of a extensive oxidation in the furnace environment. This results in the electrode being consumed in such a manner as to define the characteristic conical configuration of its lower end which results in a more rapid longitudinal wear rate at the tip than would otherwise be the case because of its smaller cross sectional area at this region. Stub end losses, that is the loss occasioned by the stub end of the eroded section breaking away from the next graphite section to which it is secured, are also significant with conventionally fed electrodes—new sections are added to the exposed end of the column protruding from the furnace—bearing in mind that the lower end of the column containing the jointed sections is subject to severe vibration and the harsh environment within the furnace for a considerable period.

Electrode consumption in this fashion accounts for a considerable cost per tonne of steel melted by the arc furnace route and efforts have been made hitherto to reduce these losses by applying a protective coating along the length of the column or by water cooling the bulk of the electrode column. It is the latter aspect with which this invention is concerned.

Hitherto, a variety of different designs of water-cooled electrode have been proposed. UK Pat. No. 1223162, for example, discloses the use of a tubular ceramic shank having water coolant pipes extending through it, these pipes constituting the electrical connection to the conventional graphite electrode sections. Belgian Pat. No. 867,876 discloses a tubular water conduit embedded in a mass of refractory material, this conduit again constituting the electrical connection to the graphite and U.S. Pat. No. 4,121,042 discloses an all-metal shank having coaxial waterways. In each of these designs however there is no shield provided around the current conducting member(s)—other than refractory material—and this can present operational draw-backs and dangers in the event of scrap in the furnace hearth fouling the refractory surface layer and bridging the arc.

Our UK Pat. No. 2037549 does provide such a shield whereby the outer casing is electrically insulated from the current carrying bus tubes, but whereas this design affords distinct advantages over the prior art, problems have been encountered when the electrode is removed from the furnace to change the graphite 'stubs' depending from the water-cooled section. In particular the water hoses have to be disconnected to effect this and the residual heat in the electrode tends to boil off the water remaining in the electrode before the change is completed, subjecting some of the electrode components to an unacceptable rise in temperature.

It is an object of this invention to provide an improved water-cooled electrode.

From one aspect the present invention provides an electrode for an arc furnace, comprising a double-walled tubular metal column, the two walls being electrically insulated from one another and defining an annular channel between them, the inner wall being electrically connected to a conductive screw-threaded member at one end thereof from which an elongated carbon or graphite section depends, and defining a central channel constituting a water flow path connected in series with the annular channel via the said member.

The screw-threaded member is preferably a hollowed male threaded member engaging with a female threaded graphite section; alternatively it may be female threaded and include a conventional screw-threaded nipple which in turn is secured to the graphite section. In the conventional manner, other graphite sections are dependent from the latter, each section being secured to its adjacent one through screw-threaded nipples.

The inner wall may be connected to the screw-threaded member by a 'spider' promoting water flow into the hollow, and this spider may be tubular in construction and apertured adjacent the base of the hollow directly to couple water therefrom with the annular channel.

A further tube may extend through the tubular column, preferably centrally thereof, and through the screw-threaded member for the introduction of an inert gas; this may bleed off through this member and diffuse through the gas permeable graphite section. The advantages of this are twofold, namely, the issuing gas provides a 'shield' around the electrode column and, more importantly, graphite section breakage or erosion can be detected simply by monitoring the gas pressure, this being aided by providing a bore in alignment with the end of this tube to extend part-way through the initially dependent graphite section.

The external surface of the electrode column (the outer metal wall) may be refractory clad; this cladding may only extend over the area adjacent the coupling with the first carbon or graphite section, 'keys' being provided over the remaining exposed surface of the outer wall to which, in operation, slag from the furnace charge may adhere. In particular, these 'keys' which may comprise discrete hooks or a helical wire scroll tack welded on to the column, extend up the column to a level near that at which it is held inside a conventional arc furnace electrode clamp when it is at its upper limit of travel, i.e. before the electrode column is slipped downwardly to ensure that the bottom graphite stub remains in contact with the furnace charge.

The outer wall of the tubular structure may be made from stainless steel whilst the inner current-carrying wall may be made from copper.

In accordance with this invention then, the outer surface of the electrode column is electrically insulated from the main bus tube and is yet water-cooled, the volume of water which may be contained within the column is approaching the maximum, ensuring adequate cooling during electrode changes, and the absense of a refractory cladding along the whole length of the exposed surface of the column substantially reduces the weight of the component.

In order that the invention may be fully understood one embodiment thereof will now be described by way of example, with reference to the accompanying drawing which illustrates a sectional side elevation through the water-cooled electrode.

Referring now to the drawing, the electrode column 1 comprises an elongated water-cooled hollow tubular steel structure having an inner wall 2 and an outer wall 3 coaxial therewith. A water inlet port 4 communicates with the annular passage defined between the two walls and a water outlet port 5 communicates with the upper end of the passage defined by the inner wall. A resilient seal 6 is mounted between metal 'caps' 7, 8 secured to the inner and outer walls at this upper end to accommodate the differential expansion between the two walls of the column, an annular insulating insert 9 being mounted behind this seal.

At the lower end a hollowed male-threaded copper nipple 10 has an upstanding copper ring 12 which in turn is secured to the inner wall 2. This ring has a number of slots formed in its lower end to accomodate the radial rectangular-section tubes 13 of a water distribution in the shape of a 'spider' having a central tube 14 dependent into the hollow. The copper nipple is secured to the lower end of the outer wall 3 via an insulating gasket 15 through screws (not shown) which are likewise insulated from the copper nipple. An annular refractory ring 16 embraces this coupling and a compressible filler is sandwiched between the upper side of this ring and a castable refractory coating 17. A 'standard' graphite section 18 is screw threaded onto the nipple 10 and a part-worn graphite stub 19 is shown coupled by a standard graphite nipple 20 screw-threaded in the same fashion and size as the copper one.

A small diameter pipe 21 extends axially through the tubular column, terminating at its lower end within the nipple 10, for a purpose which will be described in connection with the operation of this electrode.

At the upper end, the tubular structure is built-up by fabricated stainless steel pads and radial plates/stiffening rings 22 to a diameter to match that of the clamp 23 through which the electrical supply is coupled, the outer wall 24 of the built up structure being electrically insulated from the inner wall thereof 25 by insulating pads 26. Adjacent the other side of the clamp whereas the inner wall 25 is likewise built up the insulating pds 26 are sited between this wall and water-cooled copper plates or blades 27 which are in conductive contact with the clamp 23. Electrical contact with the inner wall is made via a number of copper strap connectors 28—only one of which is shown—secured to these blades.

A heat shield/slag deflector 29 for this upper coupling assembly is secured to the outer wall of the tubular electrode and below this, along the whole of the exposed surface of the outer wall a series of hooks 30 are provided as a key for slag adherence to protect the tubular structure from the hostile environment.

In operation, water is injected via the inlet port 4 through the annular waterway and, through the spider 13, into the central chamber to issue through the port 5; at the same time Argon gas is injected through the pipe 21, power is applied and an arc is drawn at the bottom end of the graphite section 19 as it is withdrawn from a scrap charge in the normal fashion.

When the sections 19 and 18 have eroded to a position close to the copper threaded section 10, the remaining graphite stub is removed and a fresh section is then added to the copper nipple. The graphite stub previously removed is then added to the lower end of the fresh section using a graphite nipple. In this way therefore there is 100%utilisation of the graphite since none is lost other than through erosion during the normal melting procedure. This mechanical function may be performed by a 'robot', either on or off the furnace, capable of withstanding the heat, and since the refractory ring 16 is exposed at this time it may readily be replaced if worn to maintain the integrity of the insulation.

The gas bled through the pipe 21 permeates through the graphite section 18 and a pressure sensor (not shown) connected in circuit with this gas feed effects a safety function in identifying any significant drop in pressure such as would be occasioned by erosion, breakage or detachment of the section 18.

The generation of eddy-currents in the metal column, which would result in spurious heating and thus reduce the efficiency of the cooled electrode, is avoided by ensuring that at least the outer wall of the tubular column is made from a non-magnetic material, e.g. austenitic stainless steel or a magnetic material fabricated to minimise induced currents.

Various modifications may of course readily be made to the design shown. For example, the outer wall of the metal column may be smooth surfaced and be encased or sleeved with a refractory cylinder or series of refractory cylinders along its length for protection instead of being provided with keys for coating adherence. Further, many of the specific materials may be replaced with other equivalents, e.g. aluminium may be substituted for copper in some instances.

I claim:

1. An electrode for an arc furnace comprising a tubular metal column having inner and outer coaxial walls, the two walls being electrically insulated from one another and defining an annular channel between them, a conductive screw-threaded member to which the inner wall is electrically connected at one end thereof, and an elongated carbon or graphite section depending from said member, the inner wall defining a central channel constituting a water flow path connection in series with the annular channel via the said member.

2. An electrode according to claim 1, comprising an apertured insert by which the inner wall is connected to the screw-threaded member and through which the water flow path is completed between the central and annular channels.

3. An electrode according to claim 2, in which the insert embodies a central tube open-ended closely adjacent the said member and incorporating a number of tubes radially extending from said central tube and communicating with said annular channel.

4. An electrode according to claim 3, in which the screw-threaded member is a hollowed male threaded member engaging with a female threaded graphite section.

5. An electrode according to claim 3, in which a further tube extends axially through the column and through the screw-threader member terminating adjacent the graphite section dependant therefrom for introduction of an inert gas to this section.

6. An electrode according to claim 5 in which the external surface of the column is refractory clad at least adjacent the said one end thereof.

7. An electrode according to claim 6, in which the external surface of the column is provided with hooks by which a slag may adhere.

8. An electrode according to claim 1, in which a resilient seal is provided at the other end of the column whereby to accomodate differential expansion between the two walls thereof.

9. An electrode according to claim 1, comprising a water cooled conductive plate coupled to the column at its other end by which electrical power is transmitted from a clamp for said electrode and the said inner wall.

10. An electrode for an arc furnace, comprising a tubular metal column having coaxial inner and outer walls, the two walls being electrically insulated from one another and defining an annular channel between them, a conductive screw-threaded member including an apertured insert to which the inner wall is electrically connected at one end thereof, an elongated carbon or graphite electrode section depending from said member and a refractory cladding on said outer wall at least adjacent the said one end thereof, the inner wall defining a central channel constituting a water flow path connected in series with the annular channel via the said apertured insert.

11. An electrode according to claim 10, comprising a resilient seal connected between the two walls at the other end of the column to accomodate differential expansion between the said walls, a water-cooled conductive plate coupled to the columm at the said other end and resilient straps connected between the plate and the inner wall by which electrical power is transmitted thereto from the said conductive plate.

12. An electrode according to claim 10, in which the inner wall is made from the copper and the outer wall is made from stainless steel.

* * * * *